United States Patent [19]

Saunders

[11] Patent Number: 4,943,067

[45] Date of Patent: Jul. 24, 1990

[54] ARROW INSERT

[76] Inventor: Thomas A. Saunders, 1424 Vinton St., Omaha, Nebr. 68108

[21] Appl. No.: 787,954

[22] Filed: Oct. 16, 1985

Related U.S. Application Data

[63] Continuation-in-part of Ser. No. 700,601, Feb. 11, 1985, abandoned.

[51] Int. Cl.[5] ..... F42B 6/04

[52] U.S. Cl. ..... 273/416; 403/13

[58] Field of Search ..... 273/416, 419–422; 403/298, 292, 268, 265, 13–15

[56] References Cited

U.S. PATENT DOCUMENTS

| | | | |
|---|---|---|---|
| 2,439,692 | 4/1948 | McKay | 403/15 |
| 3,155,405 | 11/1964 | Cadovius | 403/13 |
| 3,899,258 | 8/1975 | Matthews | 403/292 |
| 3,966,339 | 6/1976 | Nemecek et al. | 403/292 |
| 4,131,375 | 12/1978 | Fisher | 403/13 |
| 4,141,554 | 2/1979 | Sherwin | 273/420 |

FOREIGN PATENT DOCUMENTS

| | | | |
|---|---|---|---|
| 515714 | 12/1939 | United Kingdom | 403/13 |

*Primary Examiner*—Paul E. Shapiro

*Attorney, Agent, or Firm*—Henderson & Sturm

[57] ABSTRACT

An arrow insert dimensioned and configured for engagement in a hollow arrow shaft having a cylindrically shaped wall of a predetermined inner and outer diameter disposed about a longitudinal axis. The insert includes a cylindrical insert body of a first diameter adapted to be disposed within one end of the arrow shaft. An enlarged shoulder on one end of the insert body is provided for preventing the insert body from sliding too far into the arrow shaft. A pair of annular alignment rings having outer diameters slightly larger than the inside diameter of the arrow shaft are disposed in a spaced relationship with respect to each other on the exterior of the cylindrical insert body for the purpose of insuring that the insert body will be disposed within the arrow shaft so that the longitudinal axis thereof is in alignment with the longitudinal axis of the arrow shaft, whether or not the end of the arrow shaft is cut off straight, has metal burrs thereon or whether the shoulder or alignment flange is properly seated against the end of the arrow shaft. A glue trap is provided between the annular alignment rings, the insert body and an inner surface of the arrow shaft.

4 Claims, 1 Drawing Sheet

FIG. 1.
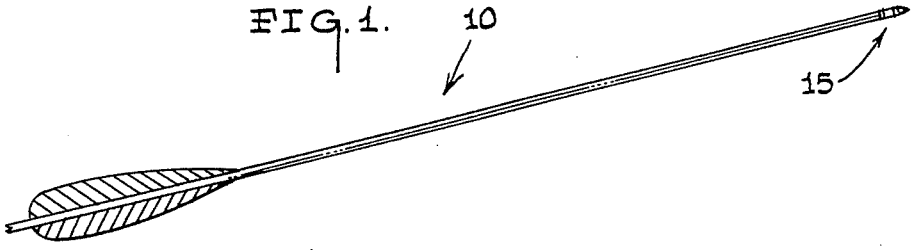
FIG. 2.
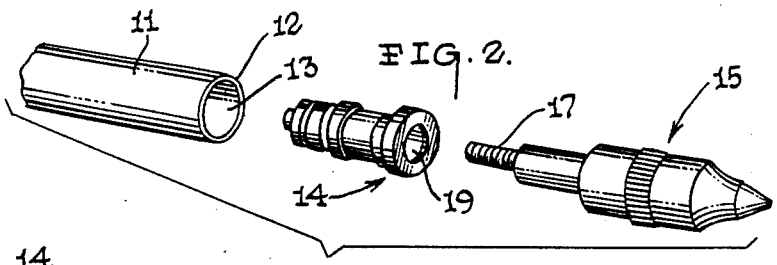
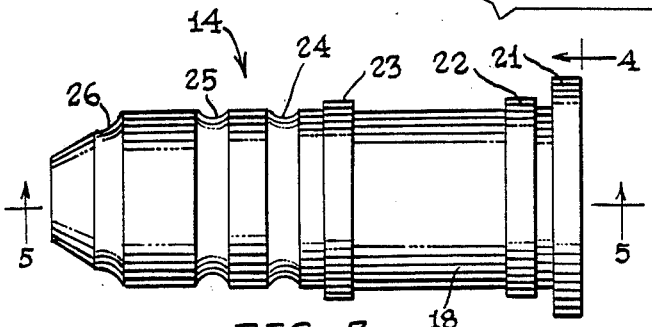
FIG. 3.
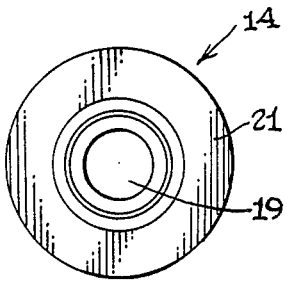
FIG. 4.
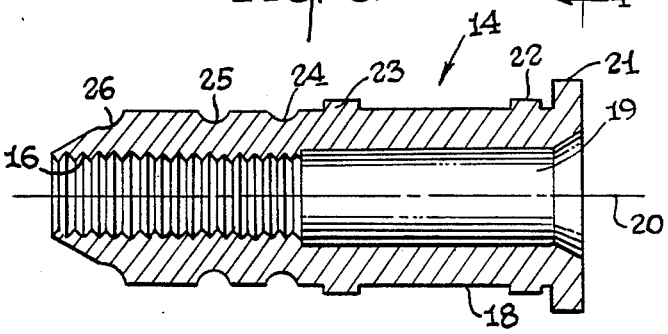
FIG. 5.
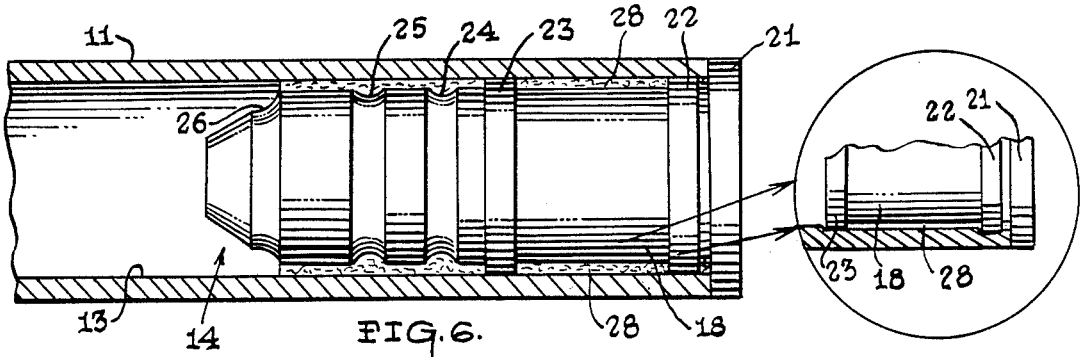
FIG. 6.

ARROW INSERT

This application is a continuation-in-part of co-pending United States patent application Ser. No. 06/700,601, filed Feb. 11, 1985 and entitled "Arrow Insert", now abandoned.

TECHNICAL FIELD

The present invention relates to an insert for a hollow arrow shaft, and more particularly to such an insert which assures that a longitudinal axis of the insert will always be in alignment with the longitudinal axis of the hollow arrow shaft.

BACKGROUND ART

Commercially available aluminum, fiberglass and other non-wooden arrows are usually formed in a tubular shaft configuration. Plastic nocks, adapted to be received on a bow string are attached to the rear end of such shaft. Various types of points, such as target points, field point, blunts, broadheads for hunting, fishing points, etc., are attached to the other end of the shaft to complete the arrow.

After an arrow shaft has been cut to a desired length, various structures have been utilized to attach a point to the front of the arrow shaft and a nock to the other end thereof. Typically, this attachment structure is a metal cylindrical structure adapted to be inserted into one open end of such tubular arrow and glued in place. The insert has something on it to permit attachment of the desired point or nock to it. This may be a surface to glue the point or nock thereto, but a common construction for points is a central threaded bore adapted to threadably receive a metal point body with threads formed on one end thereof.

Because the metal insert is glued to the interior of the front end of the tubular arrow shaft, usually by heat meltable glue, the outer diameter of such metal insert is not formed with close tolerances with respect to the interior diameter of the arrow shaft so that there will be room for an adequate amount of glue between the insert and the interior of the shaft. Because of this loose fit between the insert and the shaft, an alignment flange is provided on the front end of the metal insert for abutment with the extreme front annular surface of the shaft for causing the longitudinal axis of the metal insert, and thereby the longitudinal axis of a threaded bore, if present, to be in alignment with the longitudinal axis of the arrow shaft. This structure for achieving alignment works fine if the end of the shaft is cut off absolutely straight and no burrs or other irregularities are present on the extreme front end of the arrow shaft, and if adequate pressure is exerted on the insert to make sure that the alignment shoulder or flange is in abutment with the extreme end of the shaft. But as it turns out, it is a common problem that the insert is not properly seated or that shafts are not cut off straight or have metal burrs thereon, especially when such arrows are custom cut to a specific length for individual archers. Consequently, it is a common problem that arrow points sometimes are not in alignment with the longitudinal axis of the arrow shaft, and it is well known that arrows with such a problem do not fly straight and true. For example, if a five-sixteenth inch diameter shaft is cocked one thousandth of an inch, then a point, such as on broadhead, extending three inches out therefrom is approximately eight-thousandths of an inch off center.

Accordingly, there is a need for an arrow shaft insert for attaching the front end of a tubular arrow shaft to an arrow point which will insure proper alignment irrespective of irregularities or straightness of cut on the extreme end of the arrow shaft, or whether the insert alignment flange or shoulder is properly seated against the extreme end of the arrow shaft.

DISCLOSURE OF THE INVENTION

The present invention relates generally to a hollow arrow shaft having a cylindrically shaped wall of a predetermined inner and outer diameter disposed about a longitudinal axis. The insert includes a cylindrical insert body of a first diameter adapted to be disposed within one end of the arrow shaft. An enlarged shoulder on one end of the insert body is provided for preventing the insert body from sliding too far into the arrow shaft. A pair of annular alignment rings having different outer diameters are disposed in a spaced relationship with respect to each other on the exterior of the cylindrical insert body for the purpose of insuring that the insert body will be disposed within the arrow shaft so that the longitudinal axis thereof is in alignment with the longitudinal axis of the arrow shaft, whether or not the end of the arrow shaft is cut off straight, has metal burrs thereon or whether the shoulder is properly seated against the end of the arrow shaft. A glue trap is provided between the annular alignment rings, the insert body and an inner surface of the arrow shaft.

An object of the present invention is to provide an improved insert for the front or rear end of an arrow shaft so a nock or a point can be attached thereto.

Another object of the present invention is to provide an alignment structure for arrow shaft inserts which will automatically align the longitudinal axis of the insert with the longitudinal axis of the shaft irrespective or irregularities or straightness of cut on the extreme front end on the arrow shaft.

Another object of the present invention is to provide a structure for trapping glue between alignment rings on a structure of the aforementioned type so that adequate glue is present to prevent the insert from loosening.

Other objects, advantages and novel features of the present invention will become apparent from the following description of the best mode for carrying out this invention.

BRIEF DESCRIPTION OF THE DRAWINGS

FIG. 1 is a perspective view of an arrow having an insert constructed in accordance with the present invention inserted in the front end thereof;

FIG. 2 is a partial, enlarged, exploded, perspective view of the front end of the arrow of FIG. 1, and showing a preferred embodiment of the insert of the present invention and a field point which can be threadably attached to such insert and thereby to the end of such arrow;

FIG. 3 is a side elevational view of a preferred embodiment of the insert of the present invention;

FIG. 4 is a view of the insert shown in FIG. 3, as viewed along line 4—4 of FIG. 3;

FIG. 5 is a cross sectional view taken along line 5—5 of FIG. 3; and FIG. 6 is a cross sectional view of the end of the arrow of FIG. 1, having the insert shown in FIGS. 2-5 inserted into the end thereof and glued into place.

BEST MODE FOR CARRYING OUT THE INVENTION

Referring now to the drawings, wherein like reference numerals designate identical or corresponding parts throughout the several views, FIG. 1 shows an arrow (10) constructed in accordance with the present invention. Referring to FIG. 2, it is noted that one end (11) of the arrow (10) has a front edge surface (12) thereon and a central opening (13) adapted to receive an insert (14) constructed in accordance with the present invention. A field point (15) is also shown in FIG. 2, and is adapted to be threadably engaged with threaded portion (16) inside of insert (14). It is to be understood that other types of points, such as target points, blunts, broadheads having blades thereon for hunting large game, fishing point, or many other types of arrow points (10) can be attached to the insert instead of a field point (15) as is shown in FIGS. 1 and 2.

Referring now to FIGS. 3–5, it is noted that the insert (14) has a main body portion (18) having a central bore (19) disposed therethrough, with threads (16) being disposed on one end thereof. This bore (19) and threads (16) are formed about a longitudinal axis (20). An enlarged shoulder (21) is disposed on one end of the insert (14) and extends from the main body (18) of the insert (14) to an outer diameter thereof, such other diameter typically being matched to the outer diameter of the shaft (11) of the arrow (10).

A pair of alignment rings (22 and 23) are disposed on the exterior of the insert body (18) of the insert (14), as can readily be seen in FIGS. 3, 5, and 6. The external diameter of alignment ring (22) is larger than the outer diameter of the alignment ring (23), and alignment ring (22) forms a press fit with the interior of the shaft (11). Since these annular alignment rings (22 and 23) are slightly larger than the inside diameter of the opening (13) in the end (12) of the shaft (11), proper alignment is achieved.

These close tolerances between the diverse exterior diameters of the annular alignment rings (22 and 23) and the interior diameter of the arrow shaft (11), in combination with the fact that the annular alignment rings (22) are spaced apart by a substantial distance, will cause the longitudinal axis (20) of the insert (14) to always be in alignment with the longitudinal axis of the arrow shaft (11).

The exterior of the insert body (18) also has a plurality of grooves (24, 25 and 26) disposed therein for receiving and holding an adhesive, so that when such glue or adhesive (28) has cured by changing from a liquid to a solid condition, the insert (14) will remain in the position shown in FIG. 6, with respect to the shaft (11), unless such adhesive (28) is melted or otherwise disturbed.

To install the insert (14) to the arrow shaft (11), typically a field point (15) or the like, is threadably attached by threading the thread (17) of the field tip (15) into the thread (16) of the insert (14). Then an adhesive or glue (28) is melted and applied to the exterior of the insert (14). Such insert (14) is then pushed into the end of the arrow shaft (11) from the position shown in FIG. 2 to the position shown in FIG. 6. In the process of inserting the insert (14) into the shaft (11), a portion of the glue or adhesive (28) will be trapped between the insert body (18), the inside of the shaft (11) and the annular alignment rings (22 and 23). the rest of the glue or adhesive (28) will be located in whatever space is available to receive it; in particular, this glue or adhesive will extend into the grooves (24 and 25).

Ideally, in the process of gluing the insert (14) into the end of the shaft (11), the annular shoulder (21) on the front end of the insert (14) will abut and extend directly along the front edge (12) of the shaft (11). But, if for any reason this relationship is not obtained, for example because enough pressure was not exerted on the insert to cause such seating, or because the edge (12) is not straight and flat because of a crooked cut, or because of having burrs or other irregularities thereon, the alignment rings (22) will nevertheless positively assure that the longitudinal axis of the insert (14) will be in alignment with and coincident with the longitudinal axis of the tubular arrow shaft (11).

Accordingly, it will be appreciated that the preferred embodiment disclosed herein does indeed accomplish the aforementioned objects. Obviously, many modifications and variations of the present invention are possible in light of the above teachings. For example, the insert (14) shown could have a point attached thereto in ways other than as shown, such as having a fixture thereon to which such a point is glued. Also, alignment ring structures of other configuration and relative spacing between such structures can be utilized. It is therefore to be understood that, within the scope of the appended claims, the invention may be practised otherwise than as specifically described.

I claim:

1. The combination of: an insert; a threaded point for an arrow; and an arrow shaft having a cylindrically shaped wall of a predetermined inner and outer diameter disposed about a longitudinal axis on one end thereof, said insert comprising:

a cylindrical insert body of a first diameter adapted to be disposed in said one end of the arrow shaft;

an enlarged shoulder means disposed on said one end of said insert body extending from the inner to the outer diameter of said one end of said arrow shaft wall for preventing said insert body from sliding too far into said arrow shaft;

a first annular alignment ring means disposed on said one end of said insert body adjacent to said enlarged shoulder means, said first alignment ring means having an outer diameter of a size for causing a tight, closed slidable fit when said first alignment ring means is disposed in said one end of the arrow shaft;

a second annular alignment ring means disposed on the exterior of said insert body at a position spaced at a substantial distance from said first alignment ring means for causing the longitudinal axis of the insert body to be coincident and in alignment with the longitudinal axis of said arrow shaft, the outer diameter of said second alignment ring being larger than said first diameter of the insert body and larger than inner diameter of said arrow shaft and the outer diameter of said first alignment ring being larger than the outer diameter of said second alignment ring and larger than the arrow shaft to form a press fit with said arrow shaft; and glue trap means for forming an enclosed space between said first and second alignment ring means, said insert body and the inner wall of the arrow shaft for sealingly holding an adhesive material provided for preventing the insert body from sliding out of said one end of the arrow shaft.

2. The insert of claim 1 including grooves disposed in an outer surface of said insert body for receiving an adhesive material.

3. The insert of claim 1 including a central threaded bore disposed in one end and the center of said insert body formed about a longitudinal axis, said central threaded bore being adapted to threadably receive a threaded point for an arrow.

4. The insert of claim 1 wherein said enclosed space is at least three times the width of said first annular alignment ring means.

* * * * *